US006558303B1

(12) United States Patent
Ellis

(10) Patent No.: US 6,558,303 B1
(45) Date of Patent: May 6, 2003

(54) COMBINATION LEG EXERCISE MACHINE WITH ADJUSTABLE SEAT ASSEMBLY

(75) Inventor: Patrick D. Ellis, Oak Creek, WI (US)

(73) Assignee: Northland Industries, Inc., South Milwaukee, WI (US)

( * ) Notice: Subject to any disclaimer, the term of this patent is extended or adjusted under 35 U.S.C. 154(b) by 280 days.

(21) Appl. No.: 09/618,540

(22) Filed: Jul. 18, 2000

(51) Int. Cl.[7] ..... A63B 23/04; A63B 21/062

(52) U.S. Cl. ..... 482/138; 482/100; 482/137; 482/142; 482/908

(58) Field of Search ..... 482/100, 130, 482/136–138, 142, 908

(56) References Cited

U.S. PATENT DOCUMENTS

| | | | | | |
|---|---|---|---|---|---|
| 3,120,954 | A | | 2/1964 | Apostol | |
| 3,285,070 | A | | 11/1966 | McDonough | |
| 4,200,279 | A | | 4/1980 | Lambert, Sr. | |
| 4,441,708 | A | * | 4/1984 | Brentham | 482/112 |
| 4,556,216 | A | * | 12/1985 | Pitkanen | 482/137 |
| 4,635,933 | A | * | 1/1987 | Schnell | 482/137 |
| 4,711,448 | A | * | 12/1987 | Minkow et al. | 482/100 |
| 4,828,255 | A | * | 5/1989 | Lahman | 482/142 |
| 4,854,578 | A | | 8/1989 | Fulks | |
| 5,039,092 | A | | 8/1991 | Olschansky et al. | |
| 5,074,551 | A | | 12/1991 | Olschansky et al. | |
| 5,209,223 | A | * | 5/1993 | McGorry et al. | 482/100 |
| 5,236,406 | A | | 8/1993 | Webber | |
| 5,330,405 | A | | 7/1994 | Habing et al. | |
| 5,338,274 | A | | 8/1994 | Jones | |
| 5,403,251 | A | * | 4/1995 | Belsito et al. | 482/142 |
| 5,417,633 | A | | 5/1995 | Habing | |
| 5,667,465 | A | * | 9/1997 | McCollum et al. | 482/100 |
| 5,733,233 | A | * | 3/1998 | Webber | 482/100 |
| 5,980,434 | A | | 11/1999 | Webber | |
| 6,361,482 | B1 | * | 3/2002 | Batca et al. | 482/100 |

FOREIGN PATENT DOCUMENTS

| | | | | |
|---|---|---|---|---|
| DE | 3532445 | * | 3/1987 | 482/137 |

OTHER PUBLICATIONS

CYBEX Medical Strength Systems brochure, Modular Systems—Leg Extension/Curl, p. 12, 1993.*
TuffStuff brochure, TLE–28 Leg Extension/Curl, received in the USPTO Mar. 1998.*

* cited by examiner

*Primary Examiner*—Jerome W. Donnelly
*Assistant Examiner*—Victor Hwang
(74) *Attorney, Agent, or Firm*—Andrus, Sceales, Starke & Sawall, LLP

(57) ABSTRACT

A leg exercise machine has a support frame and a seat assembly including a seat bottom disposed upon a mounting framework secured on the frame for performing leg exercises in the form of leg extensions and leg curls. The resistance structure provides resistance to the leg exercises performed on the machine. A first roller cushion assembly is pivotally connected to the frame about a first pivot axis, is coupled to the resistance structure and is adapted to be engaged by an exerciser's legs. A second roller cushion assembly is pivotally secured to the frame about a second pivot axis and is adapted to be engaged by an exerciser's thighs for performing leg curls. The invention is improved such that at least a portion of the seat assembly is selectively adjustable relative to the frame such that the vertical distance between the first pivot axis and the plane of the seat bottom when performing leg extensions is less than the vertical distance between the first pivot axis and the plane of the seat bottom when performing leg curls.

5 Claims, 11 Drawing Sheets

COMBINATION LEG EXERCISE MACHINE WITH ADJUSTABLE SEAT ASSEMBLY

FIELD OF THE INVENTION

This invention relates broadly to a lower torso exercise machine for performing leg exercises while in a seated position. More particularly, the invention pertains to a seated assembly for such a leg, exercise machine which is adjustable to properly support the upper legs of the user during leg extensions and leg curls.

BACKGROUND OF THE INVENTION

Combination leg extension/leg curl machines have been built for many years. As with most combination weight training machines, there is some compromise in the function of one exercise, or both, to make the machine work in both functions. In the case of the leg extension/curl, the first problem is with the pivot point. Because the mechanics of doing a leg extension forces the knee down, the pivot point of the machine has to be lower in relationship to the seat cushion than when doing a seated leg curl which tends to raise the knee. The second problem is that the seat cushion must support the entire upper leg while doing leg extensions. If the seat pad extends under the lower portion of the upper leg during seated leg curls, it restrict the ability to flex the hamstring muscles completely.

One known combination exercise machine is disclosed in U.S. Pat. No. 5,980,434, issued Nov. 9, 1999 to Webber. In this patent, a free swinging roller pad assembly is adjustably mounted on a frame and movable between a down position, in which the roller pad assembly engages behind a user's knees for providing a support surface during leg extensions, and a raised portion in which the roller pad assembly engages a user's thighs for providing a bearing surface and resisting raising of the user's legs during leg curls. Webber's exercise apparatus includes a seat which is non-adjustable between leg extensions and leg curls. In the '434 patent, the plane of the seat passes substantially directly through the pivot access of the roller pad assembly in performing both leg curls and leg extensions. As a result, there is no differential between the plane of the seat cushion and the pivot axis which detracts from the proper form of the desired leg exercise.

It would be desirable to provide a combination leg exercise machine, wherein an exerciser's legs are supported in a judicious manner, such that the pivot point of the machine is lower relative to the plane of the seat cushion and the leg extension exercise than when performing a leg curl. Such relationship compensates for the tendency of the exerciser's knees to be forced downwardly in a leg extension exercise and the inclination of the exerciser's knees to be forced upwardly in a leg curl exercise. It is also desirable to provide a leg extension/leg curl exercise machine wherein the entire upper leg is supported by the seat cushion during leg extensions. It is further desirable that the seat cushion does not extend entirely along the exerciser's upper leg during leg curls because it restricts the ability to flex the hamstring muscles completely.

SUMMARY OF THE INVENTION

It is one object of the present invention to provide a combination leg exercise machine for enabling an exerciser to perform leg extensions and leg curls in a seated position.

It is also an object of the present invention to provide a leg extension and leg curl machine having an adjustable seat assembly constructed and arranged so that the plane of the seat bottom passes below the pivot axis of a pivotable leg engaging cushion assembly.

It is a further object of the present invention to provide a lower limb exercise machine wherein the seat assembly selectively places an exerciser in one predefined position to optimally perform leg extensions and another predefined position to optimally perform leg curls.

It is another object of the present invention to provide a multi-exercise machine for legs, in which a seat assembly is adjustable back and forth on a frame, such that the vertical distance between the pivot axis of a leg engaging cushion assembly and the plane of the seat bottom when performing leg extensions is less than the vertical distance between the pivot access and the plane of the seat bottom performing leg curls.

In one aspect of the invention, a leg exercise machine has a support frame, a seat assembly including a seat bottom disposed upon a mounting framework secured on the frame for performing leg exercises in the form of leg extensions and leg curls. A resistance structure provides resistance to the leg exercises performed on the machine. A first roller cushion assembly is pivotably connected to the frame about a first pivot axis, is coupled to the resistance structure and is adapted to be engaged by an exerciser's legs. A second roller cushion assembly is pivotably secured to the frame about a second pivot axis and is adapted to be engaged with an exerciser's thighs when performing leg curls. The invention is improved wherein at least a portion of the seat assembly is adjustable relative to the frame, such that the vertical distance between the pivot axis and the plane of the seat bottom when performing leg extensions is less than the vertical distance between the pivot axis and the plane of the seat bottom when performing leg curls. The support frame has a pair of tubular support members supporting a pair of aligned pillow block bearings for receiving a shaft defining the first pivot axis. The first roller cushion assembly includes a telescopic arm having a sleeve mounted for rotation on a shaft. A cam is rotatably mounted on the shaft, and is formed with a double-lobe construction. The support frame supports a weight stack, as well as a pulley arrangement on which a drive belt is entrained. One end of the drive belt is fixed to the cam, and the other end of the drive belt is attached to the weight stack. The cam is provided with a first exercise selector arrangement for moving a first roller cushion between a leg extension mode and a leg curl mode. The second roller cushion assembly includes a second exercise selector arrangement for moving a second roller cushion between a first position adapted to engage the thighs of an exerciser and a second position adapted to be spaced away from the thighs of the exerciser. The seat assembly includes a pair of spaced apart base frames joined together at one end by a stop tube having a pair of stop pads projecting therefrom. The seat assembly further includes a generally T-shaped mounting frame upon which a seat bottom is secured. The seat bottom and mounting frame are constructed and arranged to be shifted between a forward position corresponding to a leg extension position, and a rearward position corresponding to a leg curl position by means of a forward pivot link and a rearward pivot link. The mounting frame has a pair of downwardly depending stop pins which are alternately engageable with the stop tube or stop pads. The drive belt is wrapped around one lobe of the cam during leg extensions and wrapped around the other lobe during leg curls. The knees of the exerciser are adapted to flex in the vicinity of the first pivot axis. The rotational range of the second lower cushion assembly is limited by engagement of a tab with a stop pin provided on an L-shaped tube supported on the frame.

In another aspect of the invention, a leg extension and leg curl exercise machine includes a support frame, a seat assembly including a cushioned seat bottom mounted on the frame for performing leg extension and leg curl exercises in a seated position and a resistance structure for providing resistance to the leg extensions and leg curls performed on the machine. A lower roller cushion assembly is pivotally connected to the frame about a first pivot axis in front of the seat assembly and coupled to the resistance structure for providing resistance to leg extensions and leg curls in both forward and rearward pivot directions. The lower roller cushion assembly is adapted to be engaged with an exerciser's legs while seated on the seat assembly to perform leg extensions and leg curls. An upper roller cushion assembly is pivotally secured to the frame about a second pivot axis and is movable between a raised position spaced above an exerciser's thighs during leg extensions and a lowered position against the top of an exerciser's thighs during leg curls. With this construction, the seat bottom is adjustable between a leg extension position such that the plane of the seat bottom is located below the first pivot axis and a leg curl position located downwardly and rearwardly of the leg extension position.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
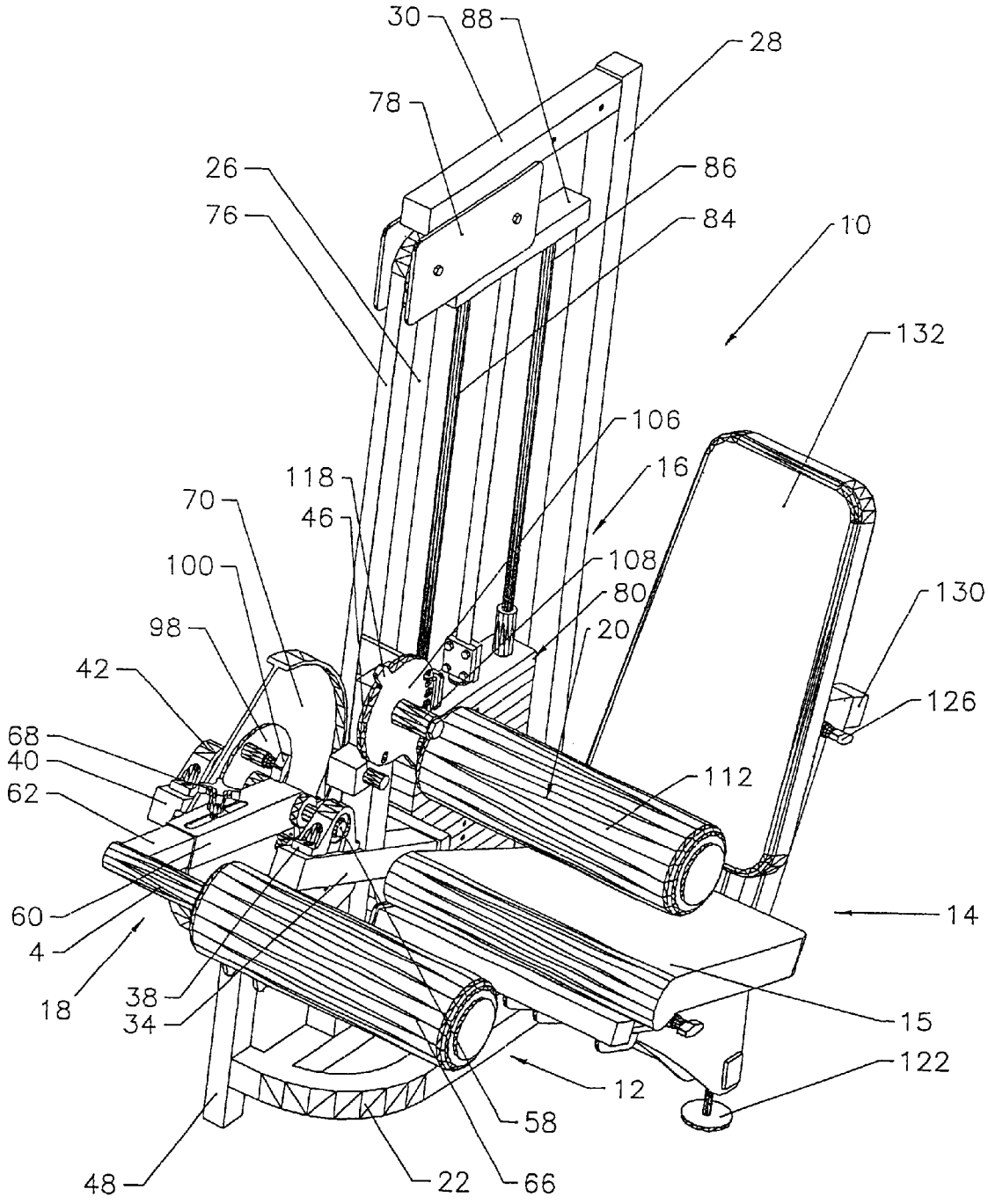
FIG. 1 is a front perspective view of a leg exercise machine provided with an adjustable seat assembly illustrating a pair of roller cushions in a start position for performing leg curls.

Referring now to the drawings, there is shown a combination leg extension and leg curl exercise machine 10 comprised of a support frame 12, a seat assembly 14 including a cushioned seat bottom 15 for enabling the leg extensions and leg curls to be performed in a seated position, a resistance structure 16 for providing resistance to the leg extensions and leg curls, a rotatable lower roller cushion assembly 18 and a rotatable upper roller cushion assembly 20.

Figure 4:
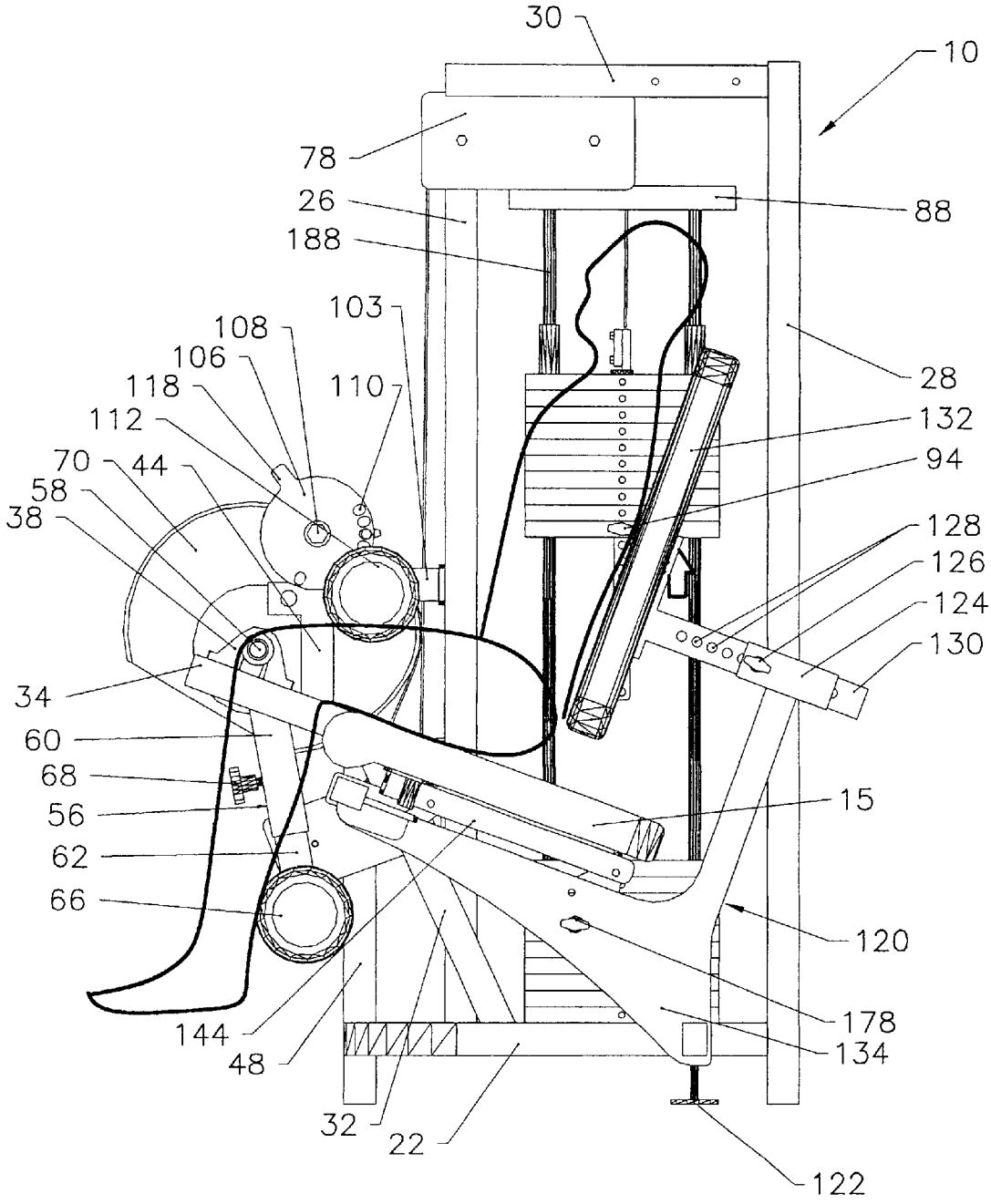
FIG. 4 is a side elevation view of the exercise machine shown in FIG. 2.
Figure 4A:
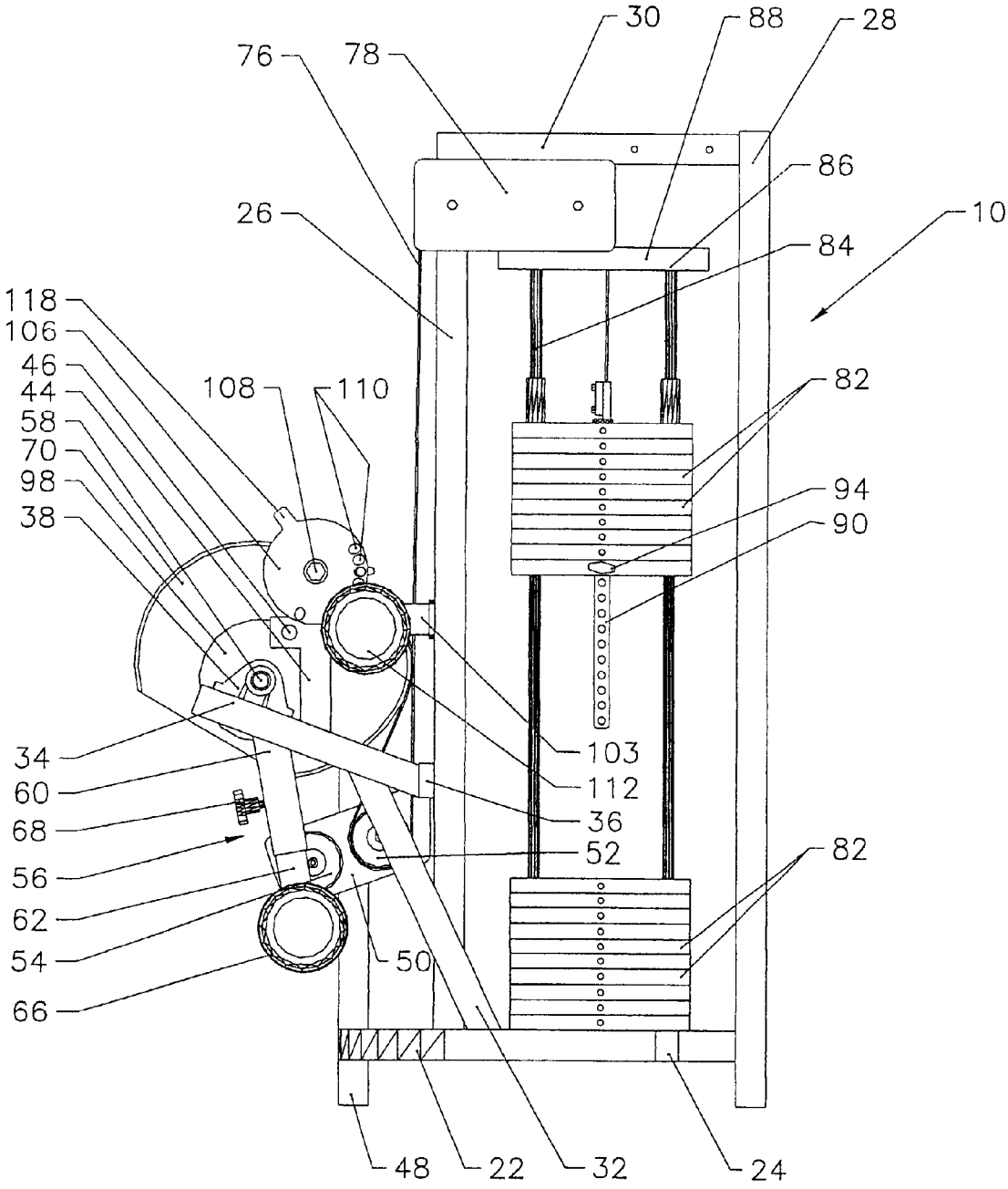
FIG. 4A is a view similar to FIG. 4 with several parts removed to show the frame structure.

The support frame 12 includes a base 22 provided with a laterally extending support member 24 which is fixedly joined to the rear bottom end of seat assembly 14. A pair of vertical uprights 26,28 rises upwardly from the base 22 and is connected together across the top portions thereof by a cross bar 30. The base 22, uprights 26,28 and cross bar 30 form a support structure for the resistance structure 16. A support strut 32 (FIG. 4A) extends upwardly and forwardly from base 22 terminating in a top end which is connected to the underside of a first tubular support member 34. The support member 34 has a proximal end secured by a first bracket 36 affixed on upright 26, and a distal end for supporting a first pillow block bearing 38. A second tubular support member 40 joined by bracket 36 extends parallel to the first support member 34 and carries a second pillow block bearing 42 which is aligned with first pillow block bearing 38. Welded to the intermediate portion of support member 34 is a generally upstanding, L-shaped tube 44 provided with a stop pin 46 used to limit the rotational range of upper roller cushion assembly 20. A tubular beam 48 rises vertically upwardly from the forwardmost end of support frame 12 and provides support for a rectangular mounting plate assembly 50 for rotatably disposing a pair of spaced apart pulleys 52,54 thereon.

Lower roller cushion assembly 18 is located in front of the seat assembly 14 and includes a telescopic arm 56 having a sleeve 57 (FIG. 6) mounted for rotation about a first horizontal pivot axis provided by a shaft 58 which is journaled in pillow block bearings 38,42. Arm 56 has an outer tube 60 which is slotted and slidably receives an inner tube 62 which is joined to an extension 64 on the end of a cylindrical, lower leg-engaging cushion 66. Although not shown, the outer tube 60 may be provided with a counterweight for balancing the arm 56 about axis 58. An adjustment screw having a handle grip 68 is provided to lock the outer tube 60 and inner tube 62 together at a desired setting which corresponds to the lower limb length of the exerciser.

Figure 2:
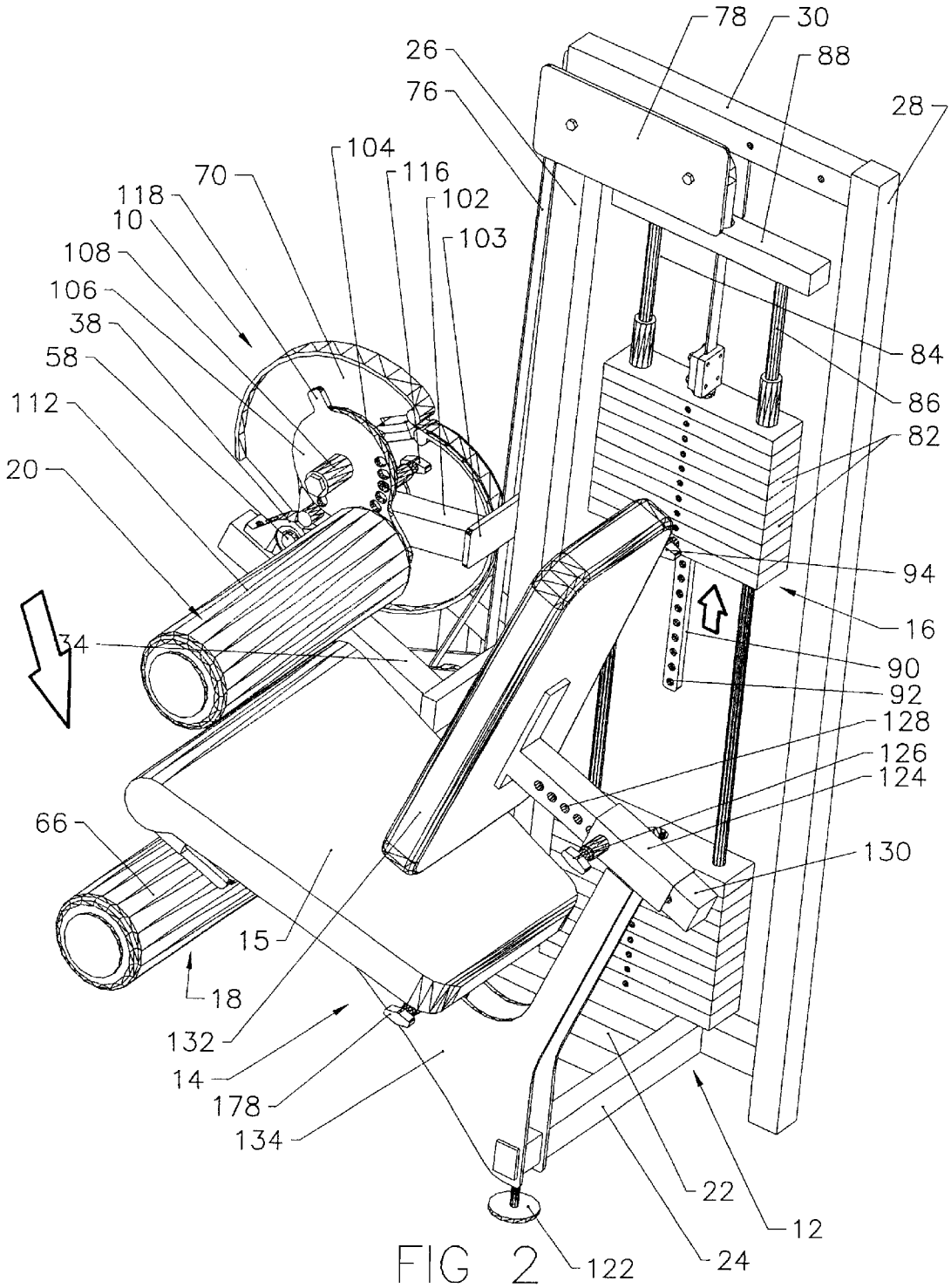
FIG. 2 is a rear perspective view similar to FIG. 1 illustrating the roller cushion in a finish position for performing leg curls.
Figure 3:
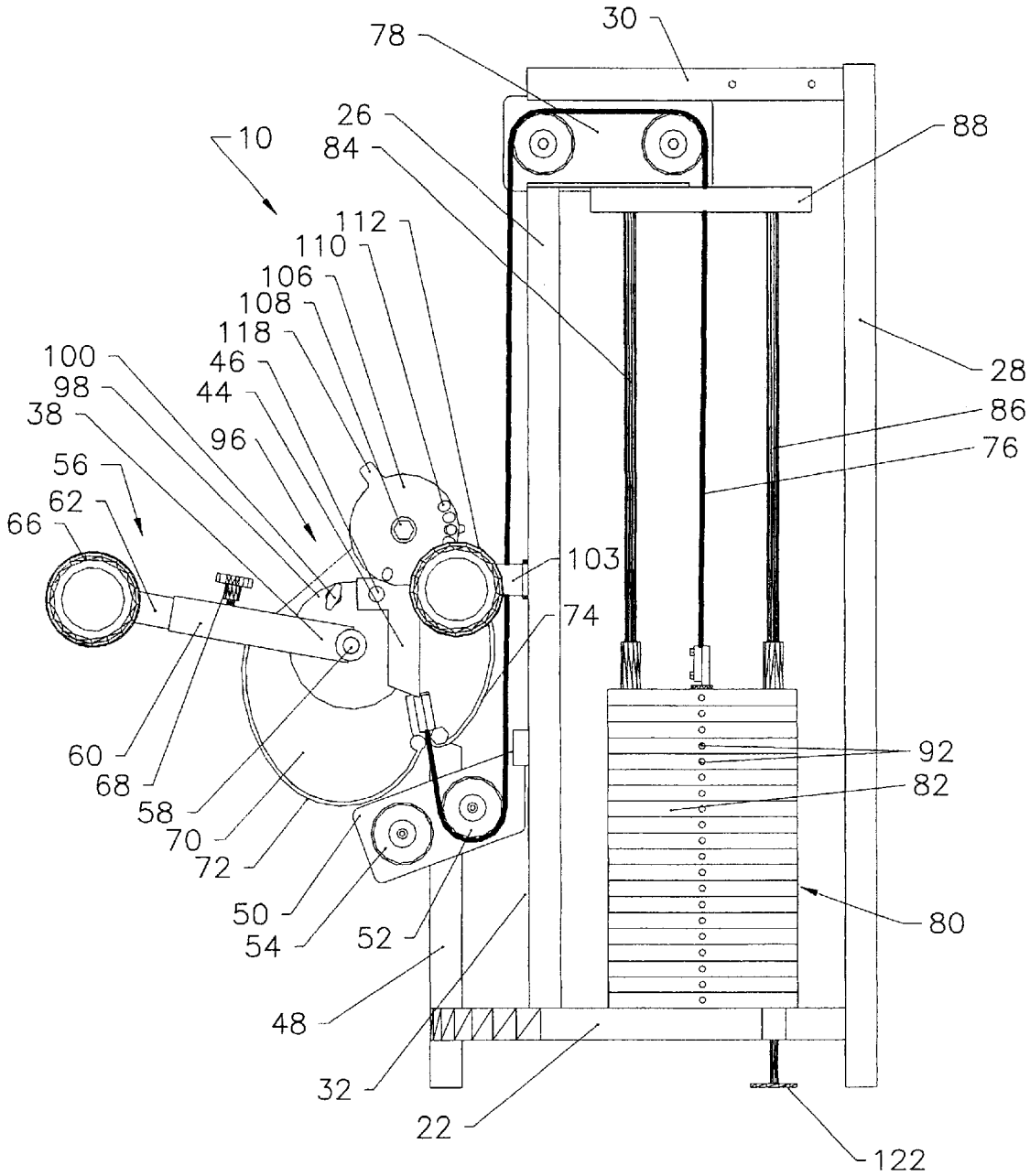
FIG. 3 is a side elevational view of the leg exercise machine shown in FIG. 1.

In order to transmit motion from the arm 56 to the resistance structure 16, a double-lobed cam 70 is rotatably mounted on the shaft 58 and is designed to rotate with the arm 56 of the lower roller cushion assembly 18. The cam 70 has separate lobe portions 72,74 (FIG. 3) for bearing the leverage during leg extensions and leg curls. As seen in FIG. 3, one end of a drive belt 76 is fixed to the cam 70 and is entrained about pulley 52. The drive belt 76 extends upwardly over a double pulley arrangement 78 at the upper end of the resistance structure 16 beneath crossbar 30. The drive belt 76 turns downwardly and has its other end connected to the top of a weight stack 80 comprised of a plurality of weight plates 82 which are slidably mounted on guide rods 84,86 between base 22 and an upper cross piece 88. The weight plates 82 are connected to a vertical rod 90 (FIG. 2) through means of apertures 92 formed therein which receive a selector pin 94 in a manner well known. The weight stack 80 is positioned adjacent the right side of the seat assembly 14 to be within the normal reach of the exerciser, such that the exerciser may select the desired resistance weight while seated on the machine 10.

Lower roller cushion assembly 18 is movable between a leg extension start position and a leg curl start positions by means of a first exercise selector arrangement 96. This selector arrangement 96 includes a circular plate 98 rotatably mounted on shaft 58 against the inside of cam 70. A spring set selector pin 100 is carried on the plate 98 and is selectively engageable with one of two openings formed in the cam 70, one of the openings corresponding to a leg extension mode and the other of the openings corresponding to a leg curl mode.

Figure 6:
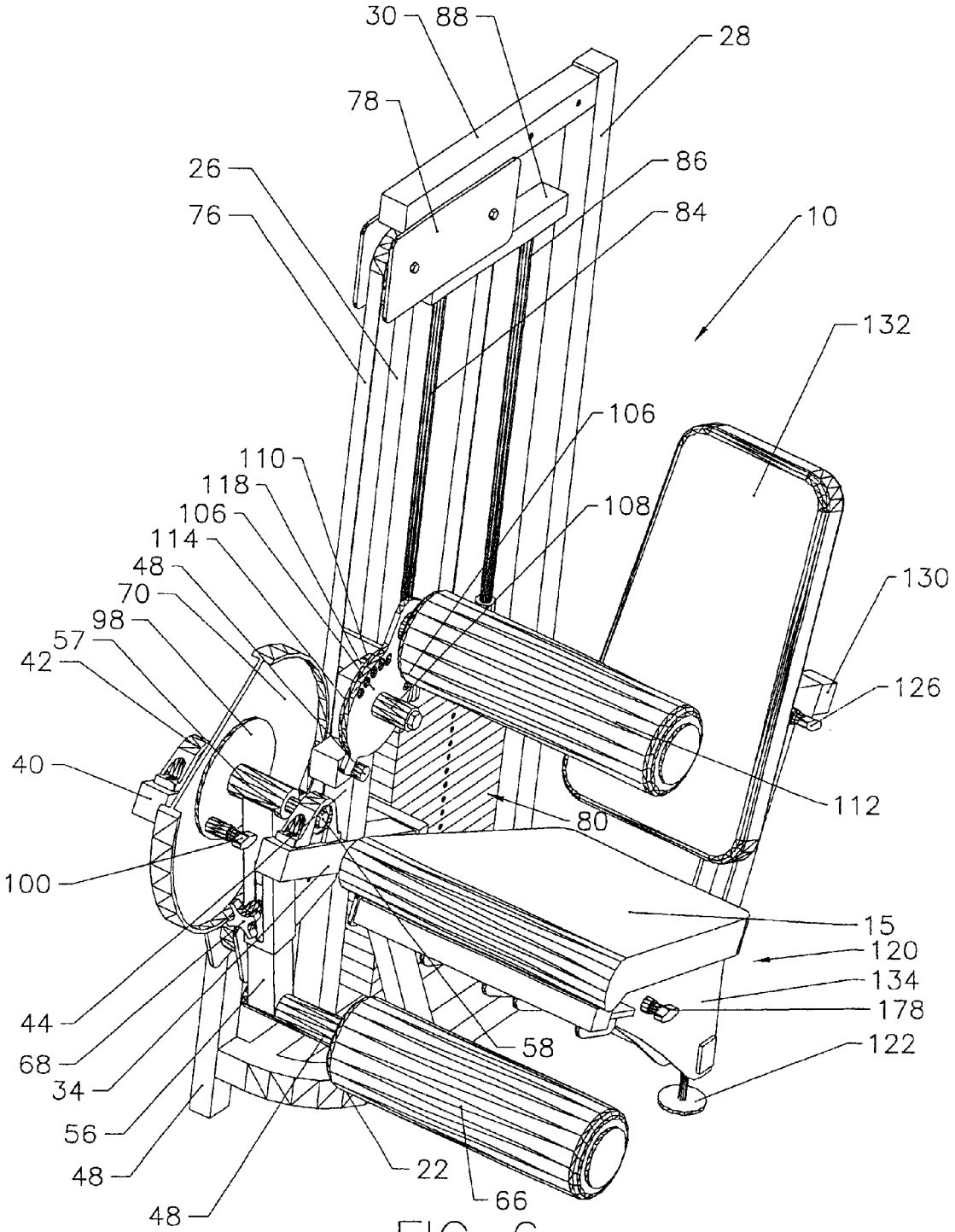
FIG. 6 is a front perspective view of the leg exercise machine of FIG. 1 showing the roller cushion in a start position for performing leg extensions.
Figure 8:
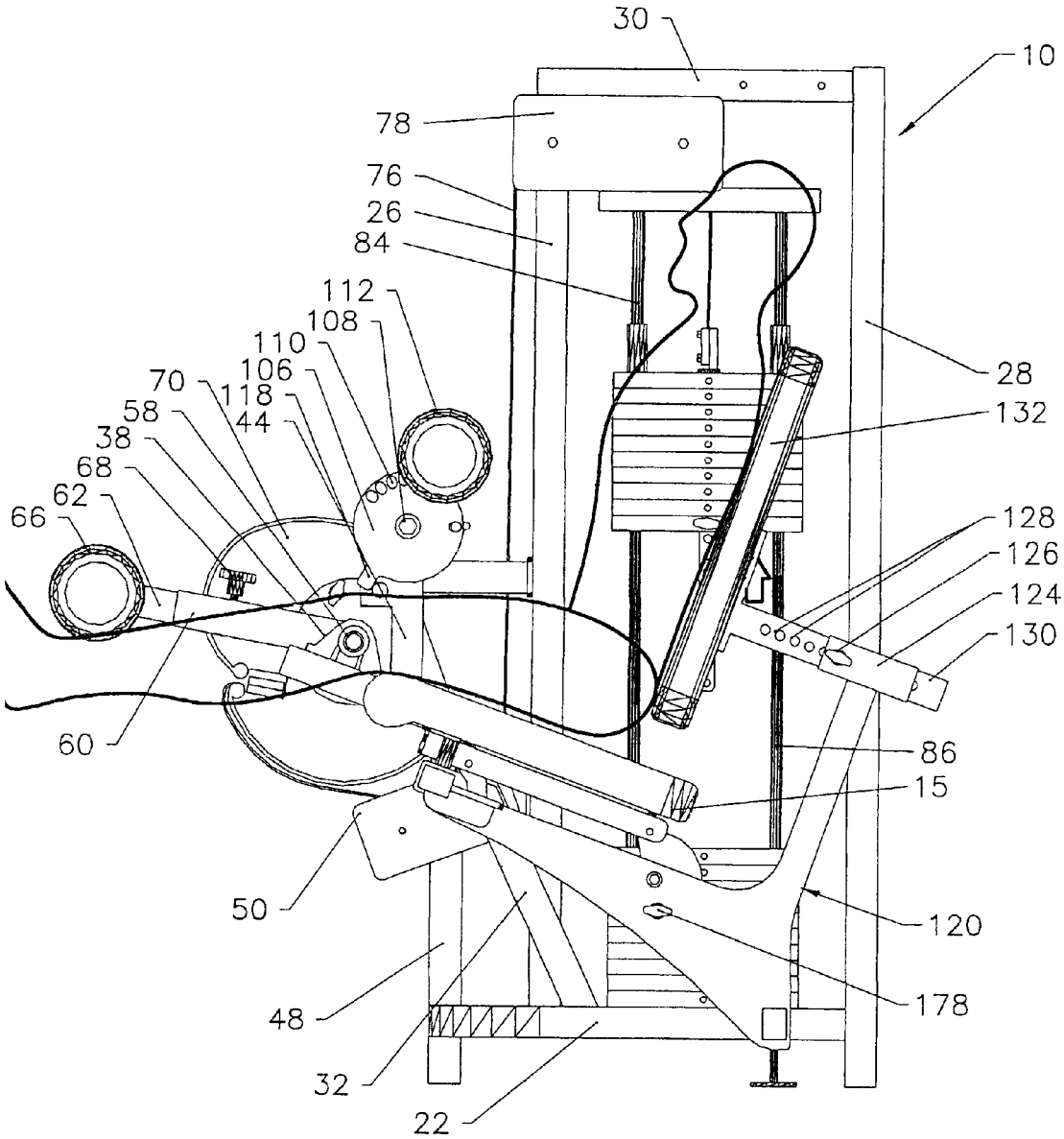
FIG. 8 is a side elevational view of the leg exercise machine of FIG. 7.

Upper roller cushion assembly 20 is located above the cushioned seat bottom 15 and functions to hold an exerciser's thighs down when performing leg curls. The upper roller cushion assembly 20; includes a third tubular support member 102 (FIG. 2) having one end connected by a second bracket 103 to upright 26 and another end connected to a second exercise selector arrangement 104 (FIG. 2). The selector arrangement 104 includes an inner plate 106 having a first portion rotatably mounted on a shaft 108 defining a second pivot axis and provided with a series of holes 110, and a second portion fixed to a cylindrical thigh-engaging cushion 112. The selector arrangement 104 also includes an outer plate 114 (FIG. 6) mounted on the shaft 108 and carrying a spring set selector pin 116 (FIG. 2), which is selectively engageable with the holes 110 formed on inner plate 106. The cushion 112 is thus movable between an uppermost position (FIG. 8) spaced above the thighs when performing leg extensions, and a thigh-engaging position (FIG. 4) when executing leg curls. In the leg extension mode, an outwardly projecting tab 118 formed on the inner plate 106 is engageable with stop pin 46 on L-shaped tube 44 (FIG. 6). The selector arrangement 104 is used to adjust for the size of an exercisers thighs and maintain a sufficient downward force on the top of one's thighs when leg curls are being performed.

Seat assembly 14 has its seat bottom 15 movably mounted upon a seat cushion assembly 120, the lower rear end of which is stabilized by a mounting foot 122 and the upper rear end of which carries a tubular sleeve 124 with a spring set selector pin 126. The pin 126 is selectively engageable with apertures 128 formed in a post 130 which extends from a backrest 132 employed to support an exerciser's back. The back rest 132 is adjustable relative to the seat bottom 15 by using the spring set pin 126 in a manner well known.

In accordance with the invention, the seat bottom 15 is adjustable between a predefined leg extension position, such that the plane of the seat bottom 15 is located below the first pivot axis 58, and a second predefined leg curl position located downwardly and rearwardly of the leg extension position. The invention further provides that the seat assembly is adjustable relative to a frame such that the vertical distance between the first pivot axis and the plane of the seat bottom when performing leg extensions is less than the vertical distance between the first pivot axis and the plane of the seat bottom when performing leg curls.

Figure 9:
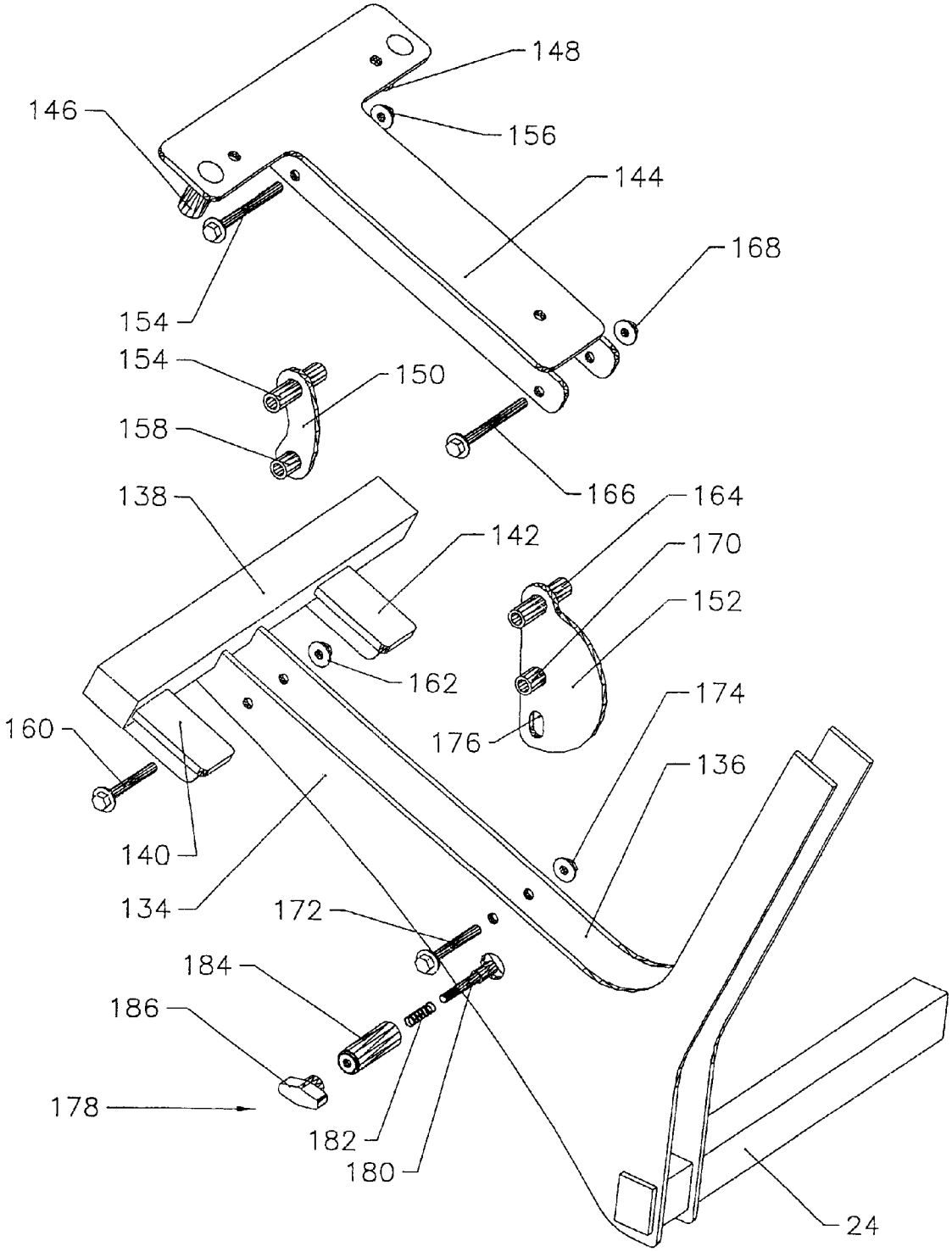
FIG. 9 is an exploded view of the adjustable seat assembly embodying the present invention.

Referring now to FIG. 9, the seat cushion assembly 120 includes a pair of parallel, spaced apart, seat base frames 134,136 joined together at their front ends by a stop tube 138 having a pair of stop pads 140,142 projecting rearwardly therefrom. The seat cushion assembly 120 further includes a generally T-shaped seat cushion mounting frame 144 upon which the seat bottom 15 is fixedly secured. The forward end of the frame 144 has a pair of downwardly depending stop pins 146,148 which are alternatively engageable with the stop tube 138 or stop pads 140,142. The mounting frame 144 is designed to shift back and forth on the seat base frames 134,136 by means of the forward pivot link 150 and a rearward pivot link 152 interposed therebetween. Forward pivot link 150 has an upper sleeve 152 connected to frame 144 by a bolt 154 and a nut 156, and a lower sleeve 158 connected to the forward end of seat base frames 134,136 by a bolt 160 and a nut 162. Rearward pivot link 152 has an upper sleeve 164 joined to the rear end of frames 144 by a bolt 166 and a nut 168, a lower sleeve 170 secured by a bolt 172 and a nut 174 to frames 134,136 and an aperture 176 formed in the lower portion thereof. Aperture 176 is selectively engageable with a spring set pin assembly 178 carried on seat base frame 134 and including an engagement pin 180, a spring 182, a spring pin body 184 and a spring pin knob 186.

Figure 10:
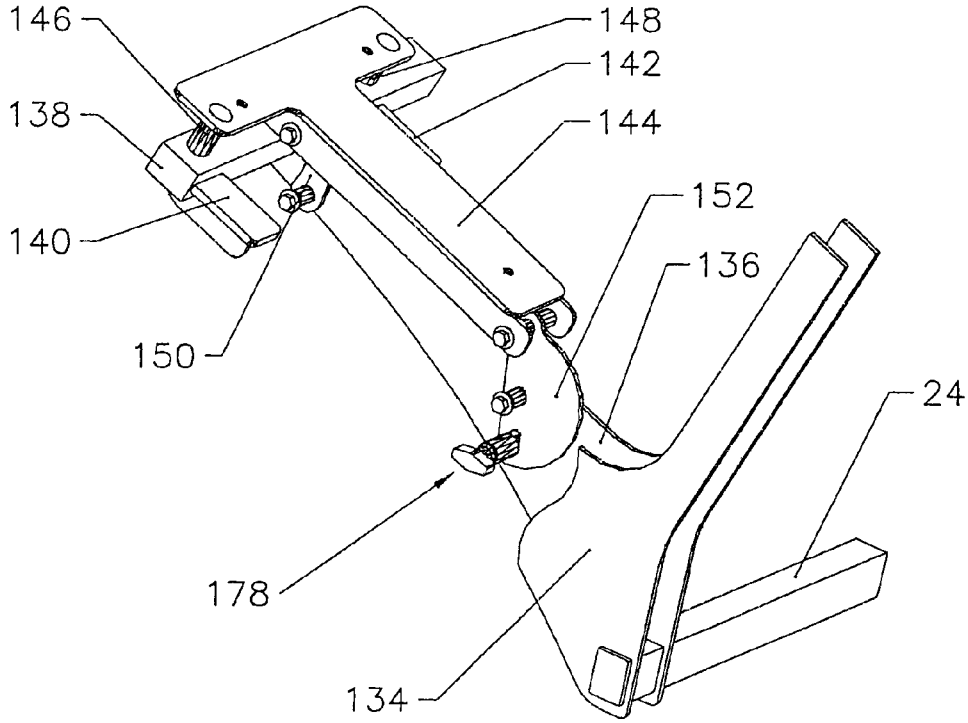
FIG. 10 is a fragmentary perspective view of the adjustable seat assembly in a leg extension position.
Figure 11:
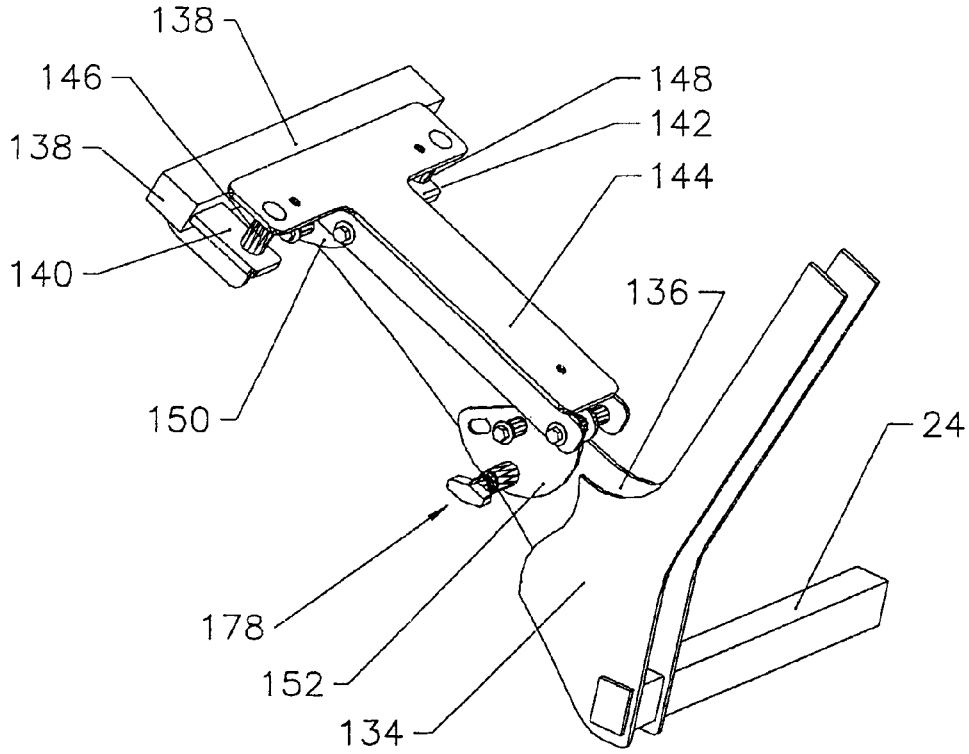
FIG. 11 is a fragmentary perspective view of the adjustable seat assembly in a leg curl position.

In the leg extension position shown in FIG. 10, it can be seen that the frame 144 is in a forward position with the stop pins 146,148 resting on stop tube 138. In this position, the spring set pin assembly 178 is engaged in the aperture 176 on rearward pivot link 152. When it is desired to attain the leg curl position shown in FIG. 11, the pin assembly 178 is retracted so that the seat bottom 15 is shifted rearwardly and downwardly by the weight of the empty seat or the added weight of the seated exerciser, to place the stop pins 146,148 upon the stop pads 140,142. Thus, the shape of the forward pivot link 150 and rearward pivot link 152 facilitate the smooth and easy shifting of the seat bottom 15 relative to the seat cushion assembly 120.

Figure 5:
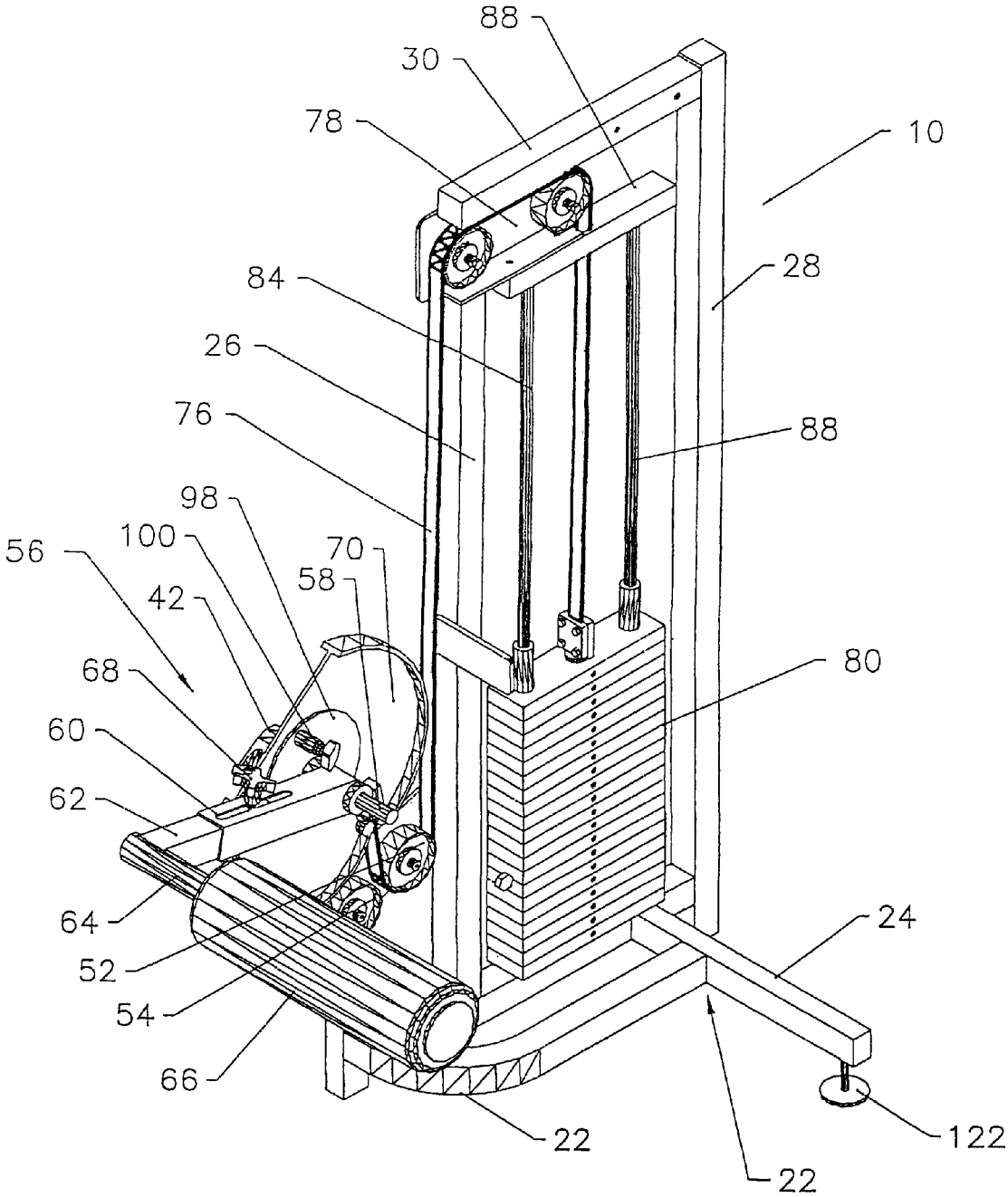
FIG. 5 is a front perspective view of the leg exercise machine of FIG. 1 with parts removed to illustrate the drive belt and pulley arrangement.

In use, if the exerciser wishes to perform leg curls, the selector pin 100 is retracted to allow the arm 56 to be moved to the raised position shown in FIGS. 1, 3 and 5. The exerciser then assumes the seated position on seat bottom 15, moves the seat bottom to the rearward position using spring set pin assembly 178 and positions both ankles on the top of the lower cushion 66. Then, the selector pin 116 is retracted as the exerciser is seated to bring the upper cushion 112 on top of the exerciser's thighs so as to restrain the exerciser's knee from rising upwardly during the leg curl motion. At this point, the exerciser selects a desired weight on weight stack 80 while seated, and proceeds to exercise the leg biceps by pushing downwardly toward the finish position shown in FIGS. 2 and 4. The exerciser may adjust for his or her lower limb length using, the adjust screw 68, and may also adjust the position of the back rest 152 so that a longitudinal axis 188 (FIG. 4) taken through the exerciser's upper torso is generally parallel to the back rest 132 and perpendicular to the seat bottom 15. It should be appreciated that the flexing of an exerciser's lower legs at the knee joint is generally coincident with the first pivot axis 58 so as to obtain the maximum result of the exercise. It should also be appreciated that the drive belt 76 is wrapped around the particular contour of cam lobe 72 during the biceps exercise so as to provide the optimum leverage in performing the leg curl.

Figure 7:
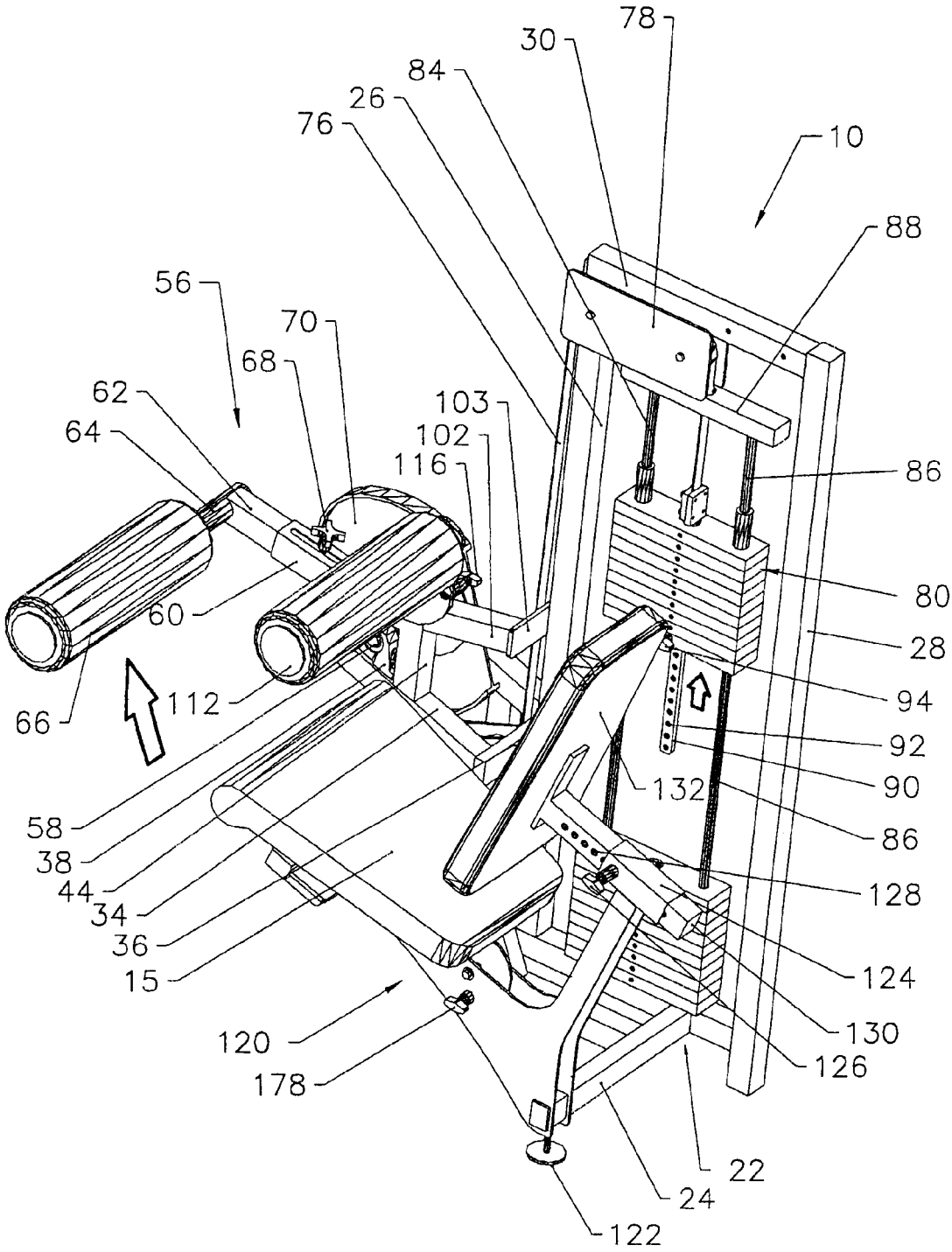
FIG. 7 is a rear perspective view similar to FIG. 2 illustrating the roller cushions in a finish position for performing leg extensions.

If the exerciser desires to perform leg extensions, the selector pin 100 is retracted to permit arm 56 to be rotated to the lower position illustrated in FIG. 6. With the exerciser seated, the seat bottom 15 is moved to the forward position by placing pin 180 into engagement with the aperture 176 on rearward pivot link 152, and the selector pin 116 is retracted to position the upper cushion 112 away from the exerciser's thighs, such that the tab 118 engages stop pin 46. With the proper weight selected, the exerciser positions both shins against the lower cushion 66 and proceeds to exercise the leg quadriceps by applying an upward force to rotate the arm 56 about first pivot axis 58 towards the finish position shown in FIGS. 7 and 8. Again, it should be noted that during the leg extensions, the knee is flexed about the pivot axis 58 and the drive belt 76 follows the particular contour of the other cam lobe 74.

It should be realized that the adjustable seat assembly 14 thus enables leg biceps and quadriceps to be performed readily in a sedentary position exercising both legs together. The predefined forward and rearward positions of the seat bottoms 15 are judiciously designed so as to best address the mechanics of the leg extension and leg curl movements. That is, the forward position will enable the seat bottom 15 to support the entire lower portion of the upper leg during leg extensions, and will permit proper support of the lower portion of the upper leg which will not restrict the ability to flex the hamstrings completely during leg curls. During both leg exercises, the knee of the exerciser is favorably positioned in the vicinity of the first pivot axis 58. In the leg extension setting, the plane of the seat bottom 15 is advantageously disposed below the first pivot axis 58 to compensate for the tendency of the exerciser's knees to move downwardly. In the leg curl setting, the plane of the seat bottom 15 drops further below the pivot axis 58 to adjust for the proneness of the exerciser's knees to move upwardly. It should be fully appreciated that the adjustable seat assembly provides that the vertical distance $d_1$ (FIG. 8) between the pivot axis 58 and the plane of the seat bottom 15 when performing leg extensions is less than the vertical distance $d_2$ (FIG. 4) between the pivot axis 58 and the plane of the seat bottom 15 when performing leg curls.

While the invention has been described with reference to a preferred embodiment those skilled in the art will appreciate that certain substitutions, alterations and omissions may be made without departing from the spirit thereof. Accordingly, the foregoing description is meant to be exemplary only and should not be deemed limitative on the scope of the invention set forth in the following claims.

I claim:

1. In a leg exercise machine having a support frame, a seat assembly including a seat bottom disposed upon a mounting framework secured on the frame for performing leg exercises in the form of leg extensions and leg curls, a resistance structure for providing resistance to the leg exercises performed on the machine, a first roller cushion assembly pivotably connected to the frame about a first pivot axis, coupled to the resistance structure and adapted to be engaged by an exerciser's legs, and a second roller cushion assembly pivotably secured to the frame about a second pivot axis and adapted to be engaged with an exerciser's thighs when performing leg curls, the improvement wherein:

the seat bottom is selectively adjustable relative to the frame such that a distance between a planar top of the seat bottom and a parallel plane including the first pivot axis when performing leg extensions is less than the distance between the planar top of the seat bottom and the parallel plane including the first pivot axis when performing leg curls, and wherein the seat assembly includes a pair of spaced apart, seat base frames joined together at one end by a stop tube having a pair of stop pads projecting therefrom.

2. The improvement of claim 1, wherein the seat assembly further includes a generally T-shaped mounting frame upon which the seat bottom is secured.

3. The improvement of claim 2, wherein the seat bottom and mounting frame are constructed and arranged to be shifted between a forward position corresponding to a leg extension position, and a rearward position corresponding to a leg curl position by means of a forward pivot link and a rearward pivot link.

4. The improvement of claim 3, wherein the mounting frame has a pair of downwardly depending stop pins which are alternately engageable with the stop tube or stop pads.

5. The improvement of claim 1, wherein a rotational range of the second roller cushion assembly is limited by engagement of a tab with a stop pin provided on an L-shaped tube supported on the frame.

* * * * *